US008970382B2

(12) United States Patent
Bermudez Pestonit et al.

(10) Patent No.: US 8,970,382 B2
(45) Date of Patent: Mar. 3, 2015

(54) PASSIVE SECURITY SYSTEM AND EQUIPMENT ON VESSELS FOR MAN OVER BOARD SITUATIONS

(75) Inventors: Pablo Bermudez Pestonit, A Coruña (ES); Jaime Casals Diaz, A Coruña (ES); Fernando López Peña, A Coruña (ES); Richard J. Duro Fernández, A Coruña (ES); Alejandro Paz López, A Coruña (ES); Gervasio Varela Fernández, A Coruña (ES)

(73) Assignee: Scio Soft, S.L., A Coruna (ES)

( * ) Notice: Subject to any disclaimer, the term of this patent is extended or adjusted under 35 U.S.C. 154(b) by 306 days.

(21) Appl. No.: 13/259,547

(22) PCT Filed: Apr. 5, 2011

(86) PCT No.: PCT/ES2011/070229

§ 371 (c)(1),
(2), (4) Date: Apr. 12, 2012

(87) PCT Pub. No.: WO2012/007618

PCT Pub. Date: Jan. 19, 2012

(65) Prior Publication Data

US 2012/0188103 A1 Jul. 26, 2012

(30) Foreign Application Priority Data

Jul. 13, 2010 (ES) ..... 201031059

(51) Int. Cl.

| | |
|---|---|
| ***G08B 23/00*** | (2006.01) |
| ***B63C 9/13*** | (2006.01) |
| ***B63C 9/125*** | (2006.01) |

(52) U.S. Cl.

CPC ..... *B63C 9/13* (2013.01); *B63C 9/1255* (2013.01)

USPC ..... 340/573.6; 340/539.13; 342/357.52; 342/357.55; 342/357.56; 441/88; 441/89; 441/108

(58) Field of Classification Search

USPC ..... 340/573.6, 539.13, 539.11, 539.15, 340/539.23; 342/357.52, 357.55, 357.56; 441/88, 108, 89

See application file for complete search history.

(56) References Cited

U.S. PATENT DOCUMENTS 6,106,348 A * 8/2000 Loisel ..... 441/108
6,150,928 A * 11/2000 Murray ..... 340/426.14

(Continued)

FOREIGN PATENT DOCUMENTS

DE 9302050 UI 6/1993
ES 1068634 U 11/2008

(Continued)

OTHER PUBLICATIONS

International Search Report for International Application No. PCT/ES2011/070229 mailed on Aug. 8, 2011.

*Primary Examiner* — Brent Swarthout
(74) *Attorney, Agent, or Firm* — Merchant & Gould P.C.

(57) ABSTRACT

A passive security system and personal equipment on vessels is for man over board situations. The personal equipment, prepared for being worn by a crewmember of the vessel, includes a first module (2) integrated into a belt (4); a life jacket (5) folded inside of the first module (2) and attached thereto by at least one strap (6); a second module (8) placed in the interior of the first module (2), connected to the life jacket (5) and configured to inflate the life jacket (5) when it detects a man over board situation. The first module (2) has on its rear part one flap (3) configured to be opened by the life jacket (5) inflating action, allowing the passage thereof to the exterior of the first module (2). It is used as a passive security element for "man over board" situations, to allow an immediate detection of the situation and a fast rescue.

4 Claims, 4 Drawing Sheets

(56) References Cited

U.S. PATENT DOCUMENTS

| | | | | |
|---|---|---|---|---|
| 6,394,866 | B1 | 5/2002 | Brown | |
| 6,486,777 | B2 * | 11/2002 | Clark | 340/539.1 |
| 7,855,654 | B2 * | 12/2010 | Katz | 340/573.6 |
| 8,482,405 | B1 * | 7/2013 | Pierce et al. | 340/539.12 |
| 2001/0049241 | A1 | 12/2001 | McClure et al. | |
| 2004/0113836 | A1 | 6/2004 | Rickerson, Jr. | |
| 2005/0012663 | A1 | 1/2005 | Audren et al. | |
| 2006/0012483 | A1 * | 1/2006 | Ethington | 340/573.6 |
| 2006/0238357 | A1 | 10/2006 | Gautier | |
| 2013/0222142 | A1 * | 8/2013 | Marshall | 340/573.6 |

FOREIGN PATENT DOCUMENTS

| | | | |
|---|---|---|---|
| GB | 731584 | A | 6/1955 |
| WO | WO 02/077943 | A1 | 10/2002 |
| WO | WO 2006/109953 | A1 | 10/2006 |

* cited by examiner

PASSIVE SECURITY SYSTEM AND EQUIPMENT ON VESSELS FOR MAN OVER BOARD SITUATIONS

This application is a National Stage Application of PCT/ES2011/070229, filed 5 Apr. 2011, which claims benefit of Ser. No. 201031059, filed 13 Jul. 2010 in Spain and which applications are incorporated herein by reference. To the extent appropriate, a claim of priority is made to each of the above disclosed applications.

FIELD OF THE INVENTION

The present invention refers in general to passive security systems for "Man Over Board" (MOB) situations, to allow an immediate detection of said situation and a fast rescue by own means, or by nearby ships having or not the system, or by government rescue services.

BACKGROUND OF THE INVENTION

Nowadays, the existing security systems for "man over board" situations are expensive and complex and are intended and designed for large vessels, where it is complex to fall into the sea, that have their own rescue means and in which the sinking times last several minutes.

There are different types of life jackets and personal beacons, but none of them are integrated into a security system, the first being limited to keeping the sailor afloat and the second being limited to sending a generic signal.

The utility model No. 1068634, whose holder is the applicant himself, describes an emergency device in which a buoy attached to a belt inflates automatically when a man over board situation occurs. The preceding invention is improved by the present invention on the buoyancy, ergonomics and rescue capacity aspects, it being directly integrated into the government rescue systems.

DESCRIPTION OF THE INVENTION

The present invention consists of a passive security system on vessels for man over board situations, comprising:

- at least one piece of personal equipment, each piece of personal equipment prepared for being carried by a crewmember of the vessel and comprising a first module integrated into a belt;
- a piece of equipment on board, installed on the vessel.

Both the first module of each piece of personal equipment and the on-board piece of equipment have a wireless communications module through which they establish a radio-frequency link, the on-board piece of equipment being configured to monitor through said link the presence of each piece of personal equipment on the vessel and, in case of detecting the absence of a piece of personal equipment due to a man over board situation, to send an alarm signal directed to at least one crewmember of the vessel.

The personal equipment further comprises:

- a life jacket folded inside of the first module and attached thereto by at least one strap;
- a second module placed in the interior of the first module, connected to the life jacket and configured to inflate the life jacket when it detects a man over board situation, the first module having on its rear part one flap configured to be opened by the life jacket inflating action, allowing its passage to the exterior of the first module.

The second module of the personal equipment preferably comprises a radio beacon for sending an alarm signal on a particular frequency, said second module being configured to activate the radio beacon when a man over board situation occurs.

The on-board equipment may have a display screen and a radio-frequency signal receptor configured to receive the alarm signal that may be sent by the radio beacon of each piece of personal equipment, the on-board equipment being configured to guide the vessel, in case of receiving said alarm signal, by means of the display screen, to the position of the personal equipment that sends said alarm signal.

The system may further comprise a communications server, located ashore and which has a GSM communications system; where the second module of the personal equipment includes a mobile communications module and, a satellite localization module, said second module being configured to send, when a man over board situation occurs, by means of its mobile communications module an alarm message to the communications server including the localization obtained by its satellite localization module.

The second module of each piece of personal equipment is preferably configured to automatically detect the man over board situation, by:

- checking the existence of a radio-frequency link, by means of the wireless communications module, with the on-board equipment;
- checking the reception of positions by means of the satellite localization module;
- checking the existence of coverage of the mobile communications module.

The system may further comprise a communications server located ashore and which has a GSM communications system, where the on-board equipment has a mobile communications module and a satellite localization module, the on-board equipment being configured to send, when a man over board situation occurs, by means of its mobile communications module an alarm message to the communications server including the localization obtained by its satellite localization module.

The communications server may be configured to, upon the reception of an alarm message:

- obtain the localization included in said alarm message;
- identify at least one vessel within a predefined radius with respect to said localization;
- send an alarm message with the obtained localization to said at least one vessel.

The communications server is configured to, upon the reception of an alarm message:

- obtain the localization included in said alarm message;
- send an alarm message to the rescue services with the obtained localization.

The on-board equipment has a DSC message transmitter and a satellite localization module and is configured to send, when a man over board situation occurs, a DSC help message including the localization of the vessel obtained by its satellite localization module.

The on-board equipment preferably has a DSC message receptor and a display screen, being the on-board equipment configured to, upon the reception of a DSC alert message including a localization, obtain said localization and to guide the vessel, by means of the display screen, to said localization.

The wireless communications module of the second module of each piece of personal equipment and of the on-board equipment may be a Bluetooth module or a Zigbee module.

It is also an object of the present invention a piece of passive security personal equipment on vessels for man over board situations, prepared for being carried by a crewmember of the vessel and comprising:

a first module integrated into a belt.

a life jacket folded inside of the first module and attached thereto by at least one strap;

a second module placed in the interior of the first module, connected to the life jacket and configured to inflate the life jacket when it detects a man over board situation, the first module having on its rear part one flap configured to be opened by the life jacket inflating action, allowing for its passage to the exterior of the first module.

The second module preferably has a satellite localization module, a mobile communications module and a wireless communications module through which a radio-frequency link is established with a piece of the vessel on-board equipment. The second module is configured to automatically detect the man over board situation by:

checking the existence of a radio-frequency link, by means of the wireless communications module, with the on-board equipment;

checking the reception of positions by means of the satellite localization module;

checking the existence of coverage of the mobile communications module.

The second module may comprise a radio beacon for sending an alarm signal on a particular frequency, said second module being configured to activate the radio beacon when a man over board situation occurs.

The first module may comprise a mobile communications module and a satellite localization module, said first module being configured to send, when a man over board situation occurs, by means of the mobile communications module an alarm message to a communications server, including in said message the localization obtained by the satellite localization module.

The present invention provides the following advantages:

Immediate detection: The system detects the MOB situation very quickly and with great precision thanks to its own algorithm that may combine three different signals sent by three different systems.

Fast rescue: As it is based on the principle that the best rescue is the closest vessel, and thus it informs and helps the ship of the shipwrecked person, nearby ships and government rescue services with the localization.

Accurate localization: Apart from informing the nearer possible "rescuer", it provides it with information as regards the GPS position of the shipwrecked person and with the capacity to be guided to said point following the instructions of the on-board equipment.

Integration with rescue services: Apart from having its own capacity for the localization and monitoring of a MOB, the system sends alarms on the frequencies established by the IMO (International Maritime Organization) on VHF Channel 70 as well as on the 125.5 MHz radio beacon, thus ensuring its integration with worldwide rescue systems. Likewise, the on-board equipment monitors MOB alarms on VHF Channel 70 sent by other ships that, despite not having the system, have the capacity for sending messages using the on-board communications systems.

Buoyancy: By incorporating a self-inflating life jacket, the system ensures the buoyancy of the shipwrecked person and thus the localization of the body even when the person has not survived.

Ergonomic design: Unlike traditional life jackets, as it is integrated into the belt it enables to perform any task on board the ship without interference and with complete normalcy.

BRIEF DESCRIPTION OF THE DRAWINGS

There follows a brief description of a series of drawings that will help understand the invention better relating to an embodiment of said invention presented as a non-limiting example thereof.

DETAILED DESCRIPTION OF THE INVENTION

The present invention consists of a passive security system for "man over board" situations, to allow a fast detection of said situation and a fast rescue by his ship, nearby ships having or not the system or government rescue services.

The system consists of the following elements:

A piece of personal equipment which is physically attached to the person.

A piece of equipment on board which is installed on the vessel.

A communications server, located ashore and in charge of controlling the GSM communications between the different components of the system.

Figure 1:
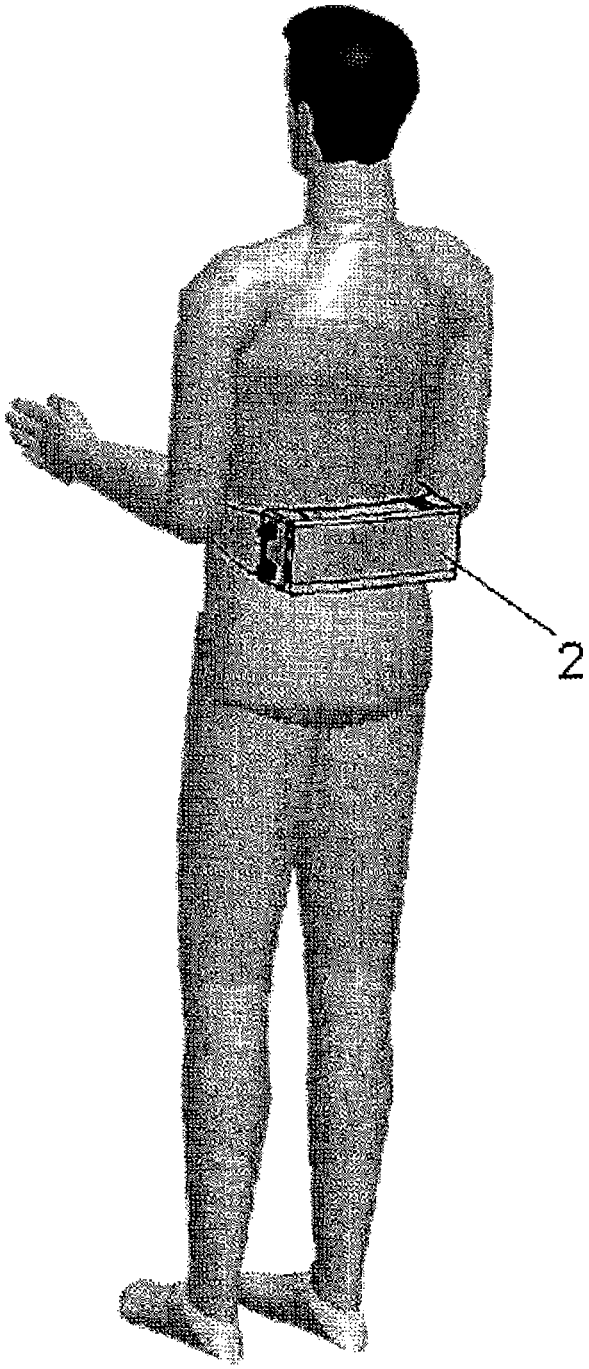
FIG. 1 shows the personal equipment that is part of the system object of the invention as it is carried by a person on board.
Figure 2:
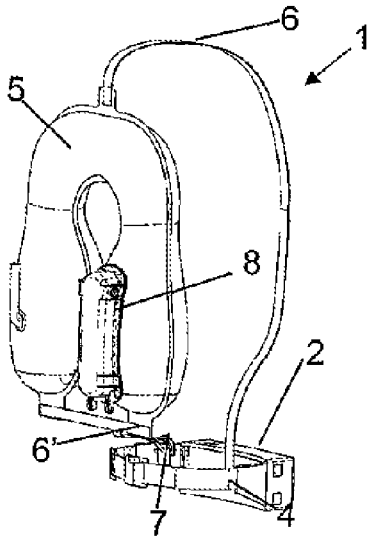
FIG. 2 shows the personal equipment with the inflated life jacket.

The personal equipment 1, as shown in FIG. 1 (where the life jacket is folded inside of the first module 2) and FIG. 2 (with the inflated life jacket), comprises:

A first module 2, integrated into a clip-on belt 4, which is adjusted to the user's back.

Life jacket 5, which is folded inside of the first module 2, whose upper part is attached to the first module 2 (preferably by means of a first strap 6) and whose lower part can be connected to the belt 4 (for example attached by means of a second strap 6' to a buckle 7 of the belt 4) when the life jacket is inflated.

A second module 8, which is inside of the first module 2 and is connected to the life jacket 5, in charge of inflating the life jacket 5 when a "man over board" situation occurs. When the life jacket 5 is inflated by this second module 8, the life jacket 5 and the second module 8 go out with force through the opening at the rear part of the first module 2, when the flap 3 which may hang loose or may be slightly attached to the first module 2 (for example with Velcro) is lifted. The life jacket-second module set is attached to the first module through the strap 6, which is mutually joined to the life jacket.

Figure 3:
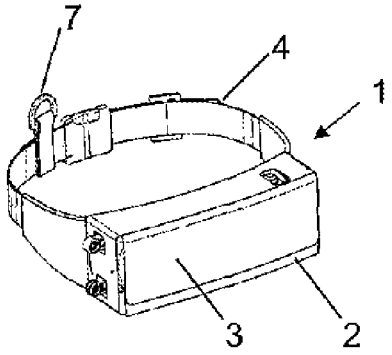
FIG. 3 shows the first module of the personal equipment, integrated into a belt.

FIG. 3 shows a view of the first module 2 of the personal equipment 1, integrated into the belt 4. The interior of said module 2 houses the second module 8, which comprises the control electronics, the GSM communications module, the Bluetooth or Zigbee communications module, the GPS receptor, a 121.5 MHz radio beacon, all of them inside of a watertight casing.

Figure 4A:
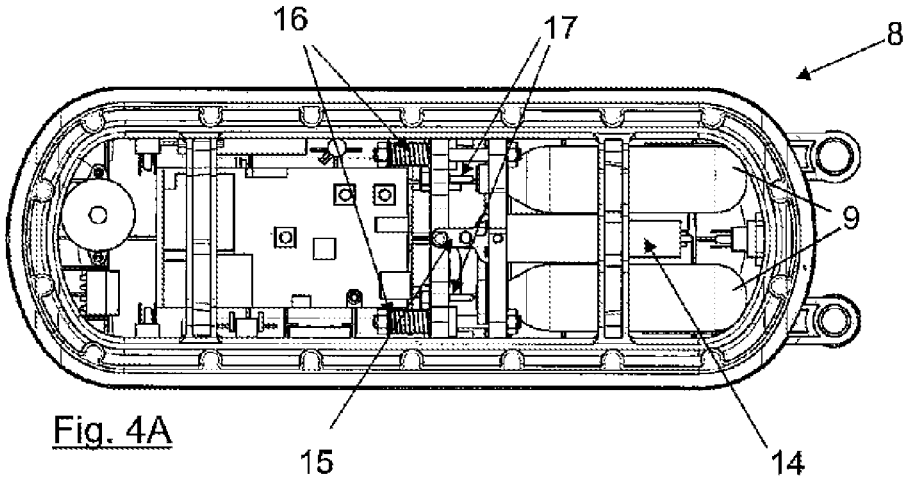
FIGS. 4A and 4B represent, respectively, an internal view and an elevation of the second module of the personal equipment, integrated into the life jacket.
Figure 4B:
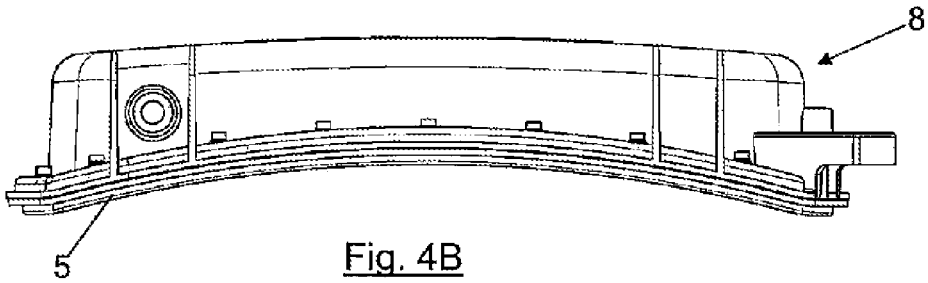

FIGS. 4A and 4B respectively show an internal view and an elevation view of the second module 8 of the personal equipment 1, which comprises two $CO_2$ bottles 9 connected to the life jacket 5 and an electrical system for the perforation thereof. The life jacket 5 is folded and connected to the rear part of the second module 8, as shown in FIG. 4B. In the preferred embodiment shown in FIG. 4A, the perforation system is composed of a servomotor 14, two retainers 15, four springs 16 and two bayonets 17. The operation is as follows:

Once mounted, the system has the springs 16 loaded and blocked by means of the retainers 15.

When the system interprets that the life jacket must be inflated it acts on the servomotor 14.

The servomotor 14 releases the retainers 15 and, consequently, the springs 16 are stretched.

With the force exerted by the extension of the springs, the bayonets 17 perforate the $CO_2$ bottles 9, so that when said system is activated (in a man over board situation) the $CO_2$ bottles 9 automatically inflate the life jacket 5. The bottles and the electrical system are inside of a watertight casing.

Both modules (2,8) of the personal equipment 1, comprise actuation buttons, to switch on and off the equipment, as well as to trigger or cancel the alarms. Specifically, they incorporate three buttons: one for the on/off operation and other two buttons that enable to cancel, when simultaneously pushed, a man over board situation or manually trigger said situation.

Figure 5:
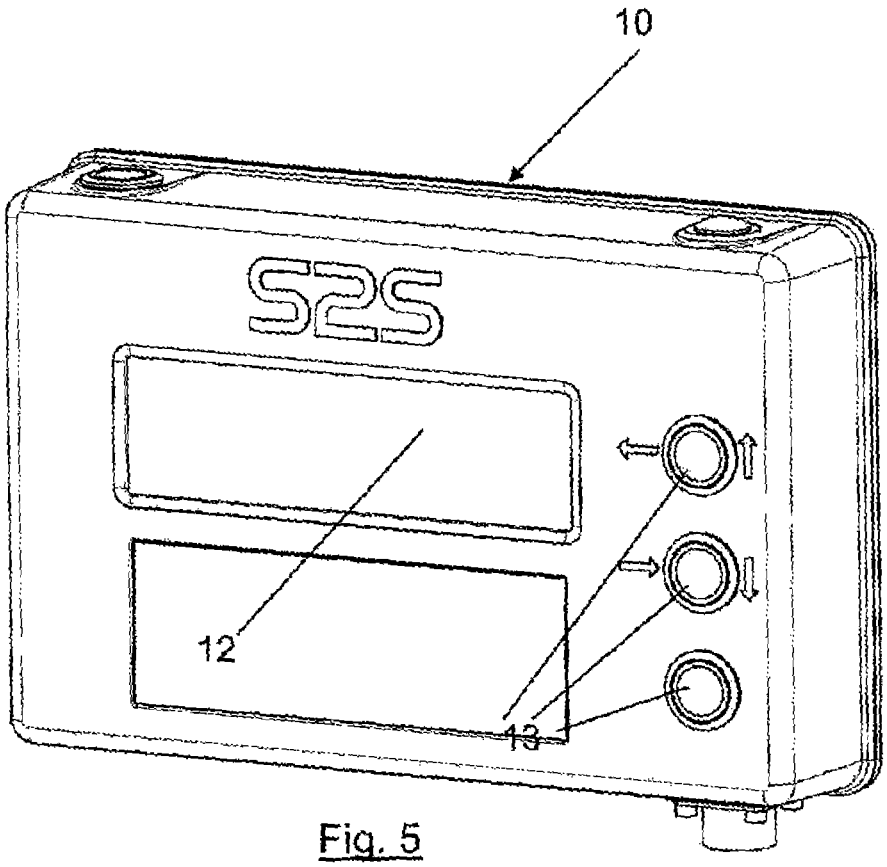
FIG. 5 represents a view of the on-board equipment, which is part of the passive security system.

FIG. 5 represents a view of the on-board equipment 10. The on-board equipment 10 is a piece of equipment that may be installed on the vessels, which includes:

Control electronics.

Display screen 12.

Buttons 13 for the on/off operation, using the menus and switching off the acoustic signal in alarm situations. It is also possible to use a touch screen as the user interface.

GSM communications module.

Bluetooth or Zigbee communications module.

GPS receptor.

DSC ("Deep Sound Channel") message transmitter and receptor on the VHF channel 70.

121.5 MHz radiofrequency signal receptor.

100 dB siren.

Finally, the communications server is constituted by one or more intermediate server type computers in a cluster configuration to ensure its continuous operation.

In case a sailor falls into the sea, the system works as follows:

Sailors get on board the vessel and put on the personal equipment 1.

The ship leaves the port and the on-board equipment is automatically set in "surveillance" mode, checking at all times that all sailors are on board, by means of the Bluetooth or Zigbee communications module, and sending from time to time a message to the communications server with the ship GPS position.

At a particular moment a sailor falls into the water.

In less than 10 seconds the personal equipment 1 detects the situation and the second module 8 inflates the life jacket 5. For detecting the situation, the personal equipment 1 checks if it has a bluetooth connection with the ship equipment. If it does not, it checks if it receives the GPS positions. If it does not receive them, it checks if it has GSM coverage. It runs the check again a given number of times (for example, three times) and if it continues without a connection on the three signals, it determines that it is in the water. The second module 8, which houses the electronics, controls the whole operation.

The on-board equipment 10 detects the situation and makes the siren ring so that the crew on-board perform the rescue. The ship equipment is constantly checking that it has a bluetooth or Zigbee connection with the personal equipment. If it loses the connection, it runs the check again a given number of times (for example, three times) and if it does not achieve it, it determines that the equipment is not on board.

If after a predetermined time the ship crew has not made the rescue (they have not cancelled the alarm) this is what happens:

The second module 8 activates the 121.5 MHz radio beacon (which may be cancelled by the user by simultaneously pushing two buttons of said second module 2) and sends a message by means of the GSM communications module to the communications server with its GPS position. The second module 8 has two buttons which may be accessed through the openings made in the first module 2.

The on-board equipment 10 sends a message by means of GSM to the communications server with the alarm and its GPS position, besides, it sends an international MOB alarm message with the GPS position on the VHF radio channel 70 to be listened to by nearby ships or by land rescue stations.

If the on-board equipment has not received the confirmation of the receipt of the alarm on the VHF radio channel 70, it sends a message to the communications server to inform it about said situation. The server identifies the ships nearby the shipwrecked person that have the system (since the server periodically receives the GPS positions of the ships that have the system) and sends an alarm with the sailor's GPS position.

The on-board equipment 10 of his ship and of the nearby ships that have the system receive the alarm with the GPS position of the shipwrecked person (on channel 70 if they are near the area or via GSM if they are not) and by means of the display screen 12 the vessel is guided to the sailor.

If there is no nearby ship (having the system or which has received the MOB alarm on the VHF channel 70) the rescue services that did receive the message on channel 70 are activated and move to the ship GPS position at the moment when the sailor fell into the water. Helped by the 121.5 MHz radio beacon they find the shipwrecked person.

In the case of the sinking of a ship, the system works as follows:

Sailors get on board the vessel and put on the personal equipment 1.

The ship leaves the port and the on-board equipment 10 is automatically set in "surveillance" checking at all times that all sailors are on board and sending from time to time a message to the communications server with its GPS position.

At a given moment the ship sinks and the sailors fall into the sea.

In less than 10 seconds the personal equipment 1 detects the situation and the second module 8 inflates the life jacket 5.

If after some seconds the alarm has not been cancelled, the second module 8 activates the 121.5 MHz radio beacon and sends a message by means of the GSM communications module to the communications server with its GPS position.

The server identifies the ships nearby the shipwrecked person(s) and sends an alarm with their GPS position.

The on-board equipment 10 of the nearby ships which have the system receives the alarm with the GPS position of the shipwrecked person(s) (arriving via GSM) and by means of the display screen 12 the vessel is guided to the sailor.

If there is no nearby ship, the rescue services are activated and moved to the ship GPS position at the moment of the sinking. Helped by the 121.5 MHz radio beacon, they localize the shipwrecked person.

The invention claimed is:

1. A passive safety device on vessels for man over board situations, configured to be worn by a person on board a vessel and comprising:

a casing integrated in a belt;

a life jacket folded inside of the casing and attached to the casing by at least one strap;

an inflation module placed in the casing, connected to the life jacket and configured to inflate the life jacket when the inflation module detects a man over board situation, the casing having on a rear part one flap configured to be opened by the life jacket inflating action, allowing the passage of the life jacket to the exterior of the casing; the inflation module comprising a satellite localization module, a mobile communications module and a wireless communications module through which a radiofrequency link is established with the on-board equipment of the vessel;

the inflation module being configured to automatically detect the man over board situation, by:

checking the existence of a radio-frequency link, by the wireless communications module, with the on-board equipment;

checking the reception of positions by the satellite localization module; and checking the existence of coverage of the mobile communications module.

2. The passive safety device according to claim 1, wherein the inflation module comprises a radio beacon for sending an alarm signal on a particular frequency, said inflation module being configured to activate the radio beacon when a man over board situation occurs.

3. The passive safety device according to claim 1, wherein the casing comprises a mobile communications module and a satellite localization module, said casing being configured to send, when a man over board situation occurs, by the mobile communications module, an alarm message to a communications server, including in said message localization obtained by the satellite localization module.

4. A passive security system on vessels for man over board situations, comprising:

at least one piece of personal equipment, each piece of personal equipment configured for being worn by a crewmember of the vessel and comprising a first module integrated into a belt;

an on-board piece of equipment, installed on the vessel;

wherein both the first module of each piece of personal equipment and the on-board piece of equipment have a wireless communications module through which the first module of each piece of personal equipment and the on board piece of equipment establish a radio-frequency link, the on-board piece of equipment being configured to monitor through said link the presence of each piece of personal equipment on the vessel and, in case of detecting the absence of a piece of personal equipment due to a man over board situation, to send an alarm signal directed to at least one crewmember of the vessel;

wherein the personal equipment further comprises:

a life jacket folded inside of the first module and attached to the first module by at least one strap, and a second module placed in an interior of the first module, connected to the life jacket and configured to inflate the life jacket when the second module detects a man over board situation, the first module having on a rear part one flap configured to be opened by the life jacket inflating action, allowing for passage of the first life jacket to the exterior of the first module;

a communications server located ashore and having a GSM communications system;

wherein the second module of the personal equipment includes a mobile communications module and a satellite localization module, said second module being configured to send, when a man over board situation occurs, by the mobile communications module, an alarm message to the communications server including the localization obtained by the satellite localization module;

wherein the second module of each piece of personal equipment is configured to automatically detect the man over board situation, by:

checking the existence of a radio-frequency link, by means of the wireless communications module, with the on-board equipment;

checking the reception of positions by the satellite localization module;

checking the existence of coverage of the mobile communications module.

* * * * *